United States Patent [19]

Craig

[11] 4,036,412

[45] July 19, 1977

[54] ELASTOMERIC CARTRIDGE WITH SLITTED NOZZLE TIP

[75] Inventor: Burnie M. Craig, Pasadena, Calif.

[73] Assignee: Loren S. Fond, Beverly Hills, Calif.

[21] Appl. No.: 634,603

[22] Filed: Nov. 24, 1975

Related U.S. Application Data

[60] Division of Ser. No. 449,822, March 11, 1974, Pat. No. 3,938,897, which is a continuation-in-part of Ser. No. 232,714, March 8, 1972, abandoned.

[51] Int. Cl.[2] ..... B65D 35/38; B65D 35/52

[52] U.S. Cl. ..... 222/490; 137/844; 222/103; 222/494

[58] Field of Search ..... 137/525, 525.1; 401/282, 283, 286–288; 222/215, 490, 491, 494, 107, 103; 239/534, 546, 598

[56] References Cited

U.S. PATENT DOCUMENTS

| | | | |
|---|---|---|---|
| 2,236,293 | 3/1941 | Lund | 137/525.1 X |
| 2,320,906 | 6/1943 | Bent | 137/525.1 X |
| 2,417,968 | 3/1947 | Browne | 137/525.1 |
| 2,771,320 | 11/1956 | Korwin | 239/534 X |
| 3,303,847 | 2/1967 | Eaton | 222/215 X |
| 3,525,357 | 8/1970 | Koreski | 137/525.1 X |

*Primary Examiner*—Robert B. Reeves
*Assistant Examiner*—David A. Scherbel
*Attorney, Agent, or Firm*—Harris, Kern, Wallen & Tinsley

[57] ABSTRACT

A toothbrush having an elongated handle provided at one end with a head comprising a surface from which bristles project in the usual manner. Within and extending longitudinally of the handle is an elongated cartridge chamber terminating at the head end of the handle with an opening communicating at one end with the chamber and at its other end with the bristled surface. The cartridge chamber is adapted to receive therein an elongated, tubular, flattenable, dentifrice cartridge insertable through an opening at the end of the chamber remote from the head. A dispensing member slidable longitudinally of and within the chamber is engageable with the cartridge to flatten such cartridge progressively from the remote end of the handle toward the head end thereof, thereby dispensing the dentifrice into the bristles of the toothbrush through an elastomeric, tubular cartridge tip disposed in the opening in the toothbrush head and extending beyond the bristled surface. The dispensing tip is provided with a peripheral wall of nonuniform thickness in cross section, such peripheral wall being provided adjacent the terminus of the tip, and within the bristles of the toothbrush head, with a self-closing slit extending longitudinally of the tip. In one form, the peripheral wall of the tip, when viewed in cross section, comprises nonconcentric inner and outer substantially circular walls, the slit being formed in the thinnest portion of the peripheral wall to facilitate opening of the slit in response to the development of pressure in the dentifrice by the slide member. In another form, the peripheral wall of the tip has a substantially circular outer cross section and a laterally elongated inner cross section with the slit being formed in one of the thicker portions of the peripheral wall for the same purpose.

2 Claims, 9 Drawing Figures

ELASTOMERIC CARTRIDGE WITH SLITTED NOZZLE TIP

CROSS-REFERENCE TO RELATED APPLICATION

The present application is a division of my application Ser. No. 449,822 filed Mar. 11, 1974, now U.S. Pat. No. 3,938,897, issued Feb. 17, 1976. Ser. No. 449,822 is a continuation-in-part of Ser. No. 232,714, filed Mar. 8, 1972, and now abandoned.

BACKGROUND OF INVENTION

The present invention relates in general to brushes and, more particularly, to a brush having means for dispensing metered quantities of a desired material into the bristles of the brush for application to the objects with which the bristles are intended to come in contact. Devices of this general character may dispense wide varieties of materials, example being such personal cleaning and/or grooming aids as dentifrices, hair grooming aids, shaving creams, of the like. Numerous other materials for other purposes may be dispensed also with devices of this general character.

Although not necessarily limited thereto, the invention will be considered herein in connection with a dentifrice dispensing toothbrush as a matter of convenience, with the understanding that various features of the invention may be incorporated in brushes of other types for dispensing other materials.

OBJECTS AND SUMMARY OF INVENTION

A general object of the present invention is to provide a dentifrice dispensing toothbrush which embodies various improvements over prior devices of this type.

The invention may be summarized as including, and a primary object is to provide a toothbrush, or similar article, which includes: a handle terminating in a head having a surface with projecting bristles; an elongated chamber extending longitudinally of the handle and adpated to receive an elongated, tubular, flattenable cartridge; a dispensing member slidable longitudinally of the cartridge chamber from one end thereof toward the head end of the handle and engageable with a cartridge in the chamber to progressively flatten the cartridge from one end of the chamber toward the other; a tubular dispensing tip of elastomeric material connected to the cartridge adjacent the head end of the cartridge chamber, and disposed in an opening through the brush head and the bristled surface thereof, for dispensing a material from the cartridge, as it is progressively flattened, into the bristles of the head of the brush; the cartridge chamber having at the end thereof remote from the brush head an opening for removal of a used cartridge and insertion of a fresh one; the handle being provided at its end remote from the brush head with a dispensing-member chamber adjacent and laterally offset from the corresponding end of the cartridge chamber; and the dispensing-member chamber receiving the dispensing member therein, a position spaced laterally from the remote end of the cartridge chamber, to leave such end of the cartridge chamber unobstructed by the dispensing member during removal of a used cartridge and insertion of a fresh one.

An important feature of the foregoing construction is that, as a used cartridge is withdrawn from the cartridge chamber, it automatically retracts the dispensing member longitudinally toward the remote end of the cartridge chamber, and displaces it laterally into the dispensing-member chamber, an important object being to provide means for releasably latching the dispensing member in its chamber in a position laterally spaced from the corresponding end of the cartridge chamber to leave the cartridge chamber unobstructed for insertion of a fresh cartridge.

Another object is to provide the handle with a longitudinal slot communicating throughout most of its length with the cartridge chamber and adjacent one end thereof with the dispensing-member chamber, the dispensing member being slidable in such a slot and having a cam surface engageable with a cartridge in the cartridge chamber.

Other objects are to provide a cartridge chamber which is longitudinally straight, and, as is preferred, a cartridge chamber which is longitudinally nonlinear. The latter has the advantage of confining the cartridge in a nonlinear configuration to minimize the column strength required of the cartridge as it is progressively flattened to dispense a material from within the cartridge into the bristles of the head of the brush.

Still another important object of the invention is to provided a cartridge chamber which is laterally elongated in cross section to provide laterally, spaced, longitudinally extending cavities to receive laterally spaced, longitudinally extending edge portions of a cartridge in the chamber as it is progressively flattened by the slidable dispensing member. This construction, by providing cavities specifically designed to receive the edges of the flattened portion of the cartridge, facilitates flattening of the cartridge and minimizes the resistance of the cartridge to flattening by the slidable dispensing member, thereby minimizing any tendency of the cartridge to buckle longitudinally ahead of the slide member, which is an important feature.

A further important object of the invention is to provide a construction wherein the opening through the brush head, for the dispensing tip of the cartridge, and the bristled surface of the cartridge intersect at an angle, with the smaller of the two angles between such opening and the bristled surface being no more than about 45°.

Another object in connection with the presently preferred embodiment of the invention is to provide a construction of the foregoing nature wherein the cartridge chamber and the opening for the dispensing tip are coaxial, and wherein the head of the brush is inclined relative to the handle, the smaller angle between the opening through the head of the brush and the bristled surface of the brush head being of the order of 25°. An important feature of this embodiment is that a very simple cartridge and dispensing tip result, the body of the cartridge and the tip being coaxial.

An object in connection with another embodiment of the invention is to provide a construction wherein the dispensing tip of the cartridge and its opening through the head of the brush are inclined relative to the axis of the cartridge chamber and the body of the cartridge at an angle of the order of about 45°. This construction, although requiring a nonlinear dispensing tip, achieves substantially the same angular relationship between the dispensing tip and the brush head as the preferred embodiment previously discussed.

As indicated above, the maximum of the smaller of the two angles between the bristled surface and the dispensing-tip opening through the brush head is no more than about 45°.

The foregoing maximum of about 45°avoids inclining the brush head relative to the handle at too severe an angle in the embodiment of the invention wherein the cartridge and its dispensing tip, and the cartridge chamber and the dispensing-tip opening, are coaxial.

In the case where the dispensing tip and its opening make an acute angle with the cartridge and the cartridge chamber, the upper limit of about 45°makes it possible to insert the dispensing tip into and through its opening with a minimum of difficulty and effort.

On the other hand, the minimum of the smaller of the two angles between the dispensing-tip opening and the bristled surface of the head is no less than about 25°.

The reason for the foregoing lower limit of about 25°is that such an angle minimizes the area of the bristled surface which must be left free of bristles to provide space for the terminus of the dispensing-tip opening, and to provide space for the projecting terminus of the dispensing tip itself.

A further object of the invention is to provide an elastomeric, tubular dispensing tip having a longitudinally extending slit adjacent its terminus, such slit being formed partially in the extreme terminal end wall of the dispensing tip and partially in a side wall thereof, and facing outwardly from the bristled surface of the brush head.

An additional object of the invention is to make the tubular dispensing tip of the cartridge of an elastomeric material and to provide the tip adjacent its terminus with a self-closing slit extending longitudinally of the tip and facing outwardly from the bristled surface of the head of the brush, the inherent resilience of the material of the dispensing tip serving to close the slit automatically when the pressure on the contents of the cartridge which is created by the slidable dispensing member is relaxed. Thus, by advancing the slide member slightly, a metered quantity of the contents of the cartridge may be dispensed, whereupon the dispensing slit automatically closes itself.

Still another important object of the invention is to provide the tubular dispensing tip with a peripheral wall of nonuniform thickness in cross section, and to so locate the self-closing slit in such peripheral wall that the slit opens in response to the development of a minimum pressure in the contents of the cartridge.

An object in connection with one embodiment of the tubular dispensing tip is to provide the peripheral wall of the tip with a cross section comprising nonconcentric inner and outer substantially circular walls, and to locate the slit in the thinnest portion of such peripheral wall.

An object in connection with another embodiment of the tubular dispensing tip is to provide the peripheral wall of the tip with a substantially circular cross section and a laterally elongated inner cross section, and to locate the slit in one of the thicker portions of the peripheral wall.

With either of the foregoing dispensing tip constructions, the pressure required to open the self-closing slit is only about one-half that which would be required if the slit were formed in a peripheral wall comprising concentric inner and outer circular walls in cross section, which is an important feature of the invention.

The foregoing objects, advantages, features and results of the present invention, together with various other objects, advantages, features and results thereof which will be evident to those skilled in the dispensing brush art in the light of this disclosure, may be achieved with the exemplary embodiments illustrated in the accompanying drawings and described in detail hereinafter.

DESCRIPTION OF EXEMPLARY EMBODIMENTS OF INVENTION

Figure 9:
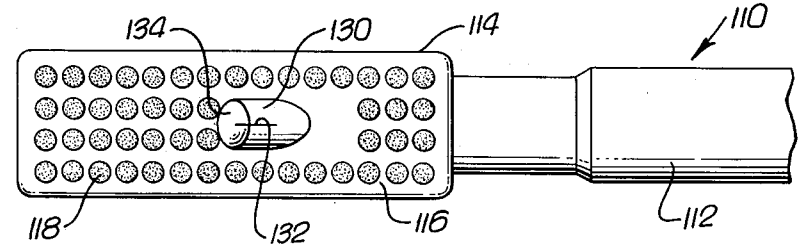
FIG. 9 is a plan view of the embodiment shown in FIG. 8 of the drawings.

Referring initially to FIGS. 1 to 5 of the drawings, the toothbrush of the invention illustrated therein is designated generally by the numeral 10 and includes a handle 12 terminating in a head 14 having a surface 16 from which bristles 18 project in the conventional manner. In the particular embodiment under consideration, the head 14 is oval, as will be clear from FIG. 1, although it may be rectangular, as shown in FIG. 9. The head 14 is inclined at an acute angle relative to the handle 12, the inclination being such that the angle of the bristled surface 16 relative to the axis of the handle 12 adjacent the head 14 is not less than about 25°, nor more than about 45°, the reasons for such angular relationship having been previously set forth.

Within the handle 12 is a dentifrice cartridge chamber 20 which is coaxial with the handle throughout a substantial portion of its length, but which is provided with a laterally offset portion 22 adjacent the end 24 of the handle. Within the cartridge chamber 20 is a dentifrice cartridge 26 which assumes a generally bowed configuration because of the hereinbefore-described configuration of the cartridge chamber itself. The cartridge 26 is made of a pliable, readily flattenable material, such as a suitable plastic.

The cartridge 26 terminates adjacent the head end of the handle 12 in an elastomeric, tubular, dentifrice dispensing tip 28 which is disposed in an opening 30 through the head 14 and projects somewhat beyond the bristled surface 16, bristles 18 being omitted from the area occupied by the projecting portion of the tip 18.

The terminus of the dispensing tip 18 is provided with a self-closing slit 32 extending longitudinally of the tip and facing outwardly into the region occupied by the bristles 18 of the toothbrush head 14 so that a dentifrice discharged through the slit is dispensed into the bristles. It will be understood that the slit 32 is rendered self closing, upon relaxation of pressure applied to the dentifrice in the cartridge 26 in a manner to be described, by the inherent resilience of the elastomeric material, preferably a suitable plastic material, of which the dispensing tip 28 is made. Preferably, the self-closing slit 32 is formed partially in the end wall 34 of the dispensing tip 28 and partially in the peripheral wall 36 thereof, the bottom of the slit being at least substantially parallel to the bristled surface 16.

Figures 1, 2, 3, 4, 5:
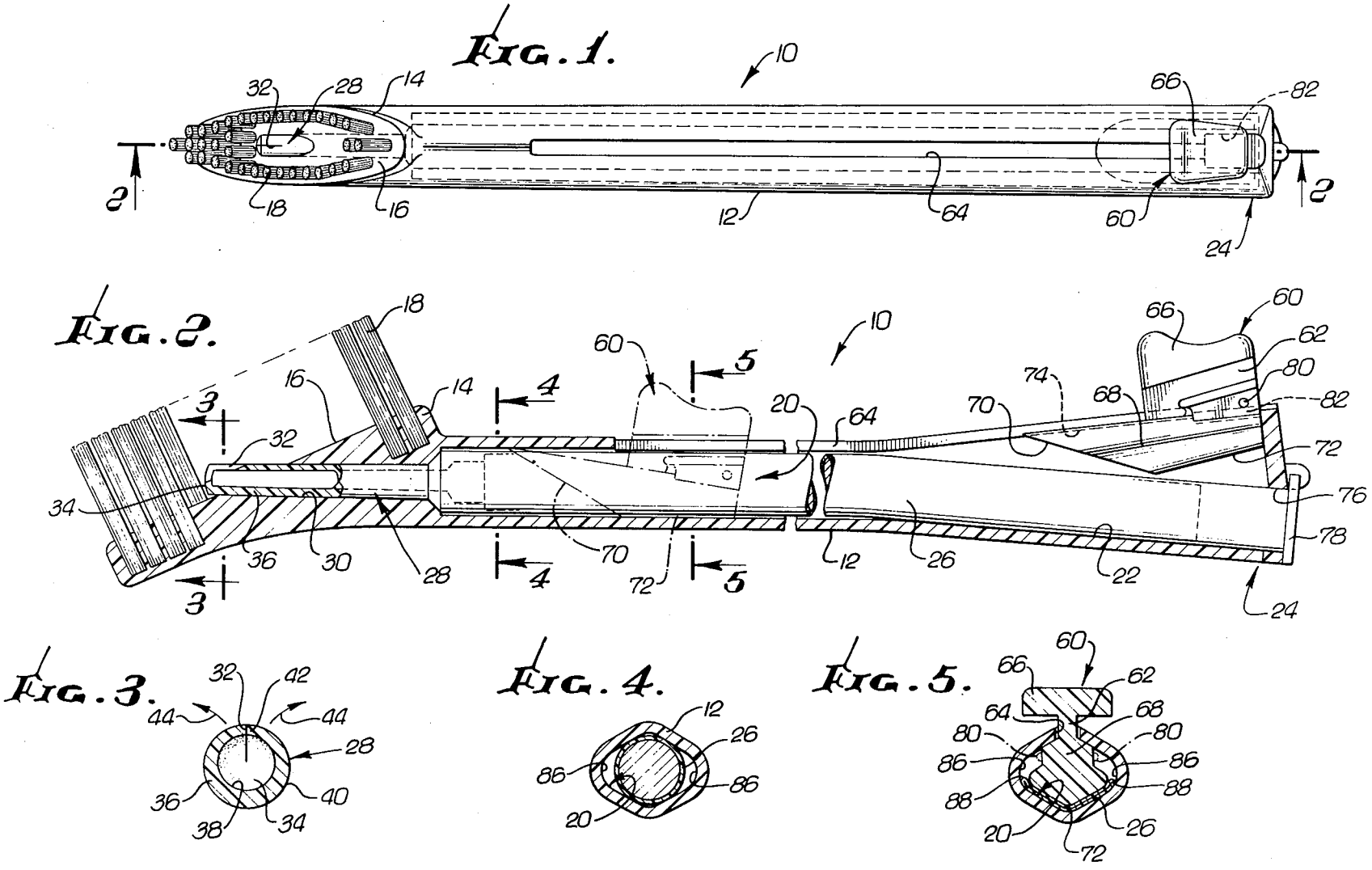
FIG. 1 is a bottom plan view of a dentifrice dispensing toothbrush which embodies the invention.
FIG. 2 is an enlarged, fragmentary, longitudinal sectional view of the toothbrush of FIG. 1 taken along the arrowed line 2—2 of FIG. 1.
FIG. 3 is an enlarged transverse sectional view of a dentifrice dispensing tip of the invention and is taken as indicated by the arrowed line 3—3 of FIG. 2.
FIGS. 4 and 5 are transverse sectional views respectively taken along the arrowed lines 4—4 and 5—5 of FIG. 2.

Turning to FIG. 3 of the drawings, in the embodiment under consideration, the peripheral wall 36 of the dispensing tip 28, when viewed in cross section, comprises nonconcentric inner and outer, substantially circular walls 38 and 40, the self-closing slit 32 being formed in the thinnest portion 42 of the peripheral wall. With this construction, when pressure is applied to the dentifrice within the cartridge 26 in a manner to be described, the slit 32 opens in such a manner that the edges thereof move laterally outwardly away from each other as generally indicated by the arrows 44. I have found that, with this construction, the self-closing slit 32 opens easily to dispense the desired metered quantity of dentifrice with a dentifrice pressure of only about one-half that which would be required if the slit were formed in a peripheral wall of uniform thickness, which is an important feature of the invention. At the same time, the slit 32 automatically closes readily and completely when the dentifrice pressure is relaxed, which is another important feature.

Figure 6:
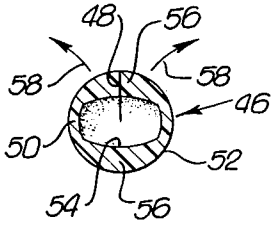
FIG. 6 is a transverse sectional view similar to FIG. 3, but showing an alternative embodiment.

Turning for the time being to FIG. 6 of the drawings, illustrated therein is an alternative dispensing tip 46 which operates in much the same way as the dispensing tip 28. More particularly, the dispensing tip 46 is provided at its terminus with a self-closing slit 48 formed at least partially in a peripheral wall 50 having a substantially circular outer cross section 52 and a laterally elongated inner cross section 54, such lateral elongation being in a plane perpendicular to the plane of the slit 48. For example, the interior of the dispensing tip 46 may be approximately oval or elliptical in cross section. The important thing in this embodiment is that the self-closing slit 48 is formed in one of the thicker portions 56 of the peripheral wall 50. This particular construction results in slit-opening movement in approximately the directions indicated by the arrows 58. The end result is that the operation of the dispensing tip 46 is very similar to that hereinbefore described for the dispensing tip 28, the same advantages being present.

Reverting to FIGS. 1 to 5 of the drawings, the dentifrice in the cartridge 26 is progressively dispensed from the dispensing tip 28 by progressively flattening the cartridge 26 from the end 24 of the chamber 20 toward the head end thereof. Such progressive flattening of the cartridge 26 is caused by a slidable dispensing member or slide member 60 having a reduced portion 62 disposed in a longitudinal slot 64 in the handle 12. The slide member 60 is provided outwardly of the slot 64 with a finger piece 66 and is provided within the handle with a cam 68 comprising a cam surface 70 and a surface 72 making an obtuse angle with each other. As shown in dotted lines in FIG. 2, as the slide member 60 progresses toward the head end of the handle 12, the surface 72 is substantially parallel to the side of the cartridge chamber 20 opposite the finger piece 66, while the cam surface 70 is inclined to progressively squeeze dentifrice from the cartridge.

The handle 12 is provided at the end 24 thereof with a slide-member chamber 74 laterally spaced from the laterally offset portion 22 of the cartridge chamber 20. With this construction, when the slide member 60 is completely retracted, as shown in solid lines in FIG. 2, it leaves the cartridge chamber 20, including the laterally offset portion 22 thereof, completely unobstructed to facilitate removal of a used cartridge 26 and insertion of a new one, both by way of an opening 76 closed by a closure 78 integral with cartridge 26. An important feature of the invention is that the slide member 60 may be releasably latched in its laterally and longitudinally retracted positions by a latching means comprising integral detents 80 on opposite sides of the reduced portion 62 and respectively engageable with the edges of a widened portion 82 of the slot 64 at the end 24 of the handle 12. As will be apparent, the slide member can be releasably latched in its laterally and longitudinally retracted positions by pulling laterally outwardly on the finger piece 16, and can be released simply by pushing laterally inwardly on the finger piece. This construction shifts the slide member 60, when in its laterally and longitudinally retracted positions, completely out of the removal path of a used cartridge 26 and the insertion path of a fresh cartridge. To remove a used cartridge 26, the closure 78 can be grasped by the user's fingers. Thus, a used cartridge 26 can be removed readily. As will be apparent, a fresh cartridge 26 can be inserted readily simply by holding the toothbrush end head end down, and then dropping a fresh cartridge 26 into the cartridge chamber 20, care being taken to properly orient the self-closing slit 32. In order to seat the dispensing tip 28 in its opening 30, it may be necessary to shake the toothbrush 10 slightly, push on the closure 78, or to tap the head end thereof lightly on a convenient surface.

It will be noted that, in withdrawing a used cartridge 26, the junction of the head end of the cartridge with the dispensing tip 28 will automatically longitudinally retract the slide member 60, even if the user does not previously longitudinally retract the slide member manually. Thus, as a used cartridge 26 is withdrawn, the slide member 60 is automatically displaced approximately into the position shown in solid lines in FIG. 2 of the drawings, simply as the result of pulling out the used cartridge, which is an important feature of the invention.

As previously mentioned, having the portion 22 of the cartridge chamber 20 laterally offset at the end 24 of the handle 12 results in bowing the cartridge 26 to some degree. Actually, as the dentifrice is dispensed from the cartridge 26 by the slide member 60, the upper side of the cartridge is in longitudinal tension to some degree, being anchored by the closure 78. The net result is that any tendency of the slide member 60 to buckle the cartridge 26 ahead of the slide member, as the dentifrice is being dispensed, is minimized, which is another important feature.

As best shown in FIGS. 4 and 5 of the drawings, the cartridge chamber 20, for at least most of its length, is laterally elongated in cross section, in a plane perpendicular to the plane of the slot 64, to provide on opposite sides of the cartridge chamber laterally spaced, longitudinally extending cavities 86 to receive laterally spaced, longitudinally extending edge portions 88 of a flattened cartridge 26 in the chamber. This construction, by providing the cavities 86 specifically designed to receive the edges 88 of the flattened portion of the cartridge and minimizes the resistance of the cartridge to flattening by the slide member 60, thereby minimizing any tendency of the cartridge to buckle longitudinally ahead of the slide member, which is an important feature.

Figure 7:
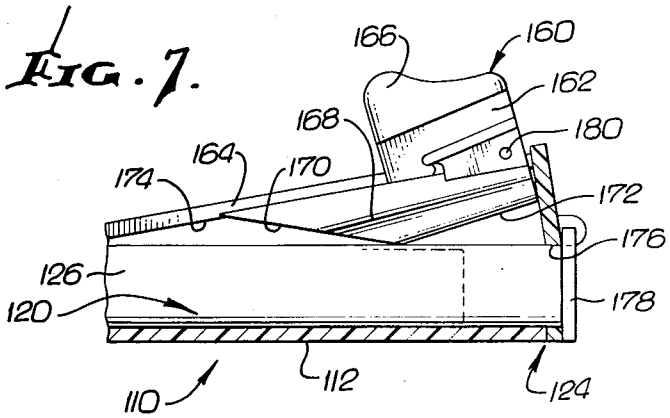
FIG. 7 is a fragmentary longitudinal sectional view similar to the right end of FIG. 2, but showing an alternative embodiment.
Figure 8:
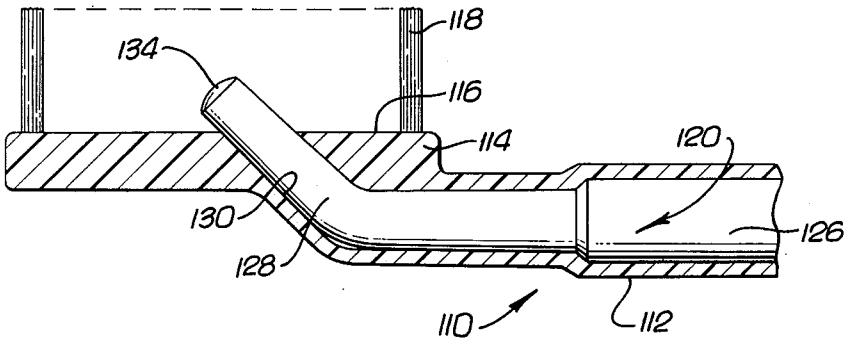
FIG. 8 is a fragmentary longitudinal sectional view similar to the left end of FIG. 2, but showing an alternative embodiment.

Turning now to FIGS. 7 to 9 of the drawings, illustrated therein is a toothbrush 110 of the invention which is generally similar to the toothbrush 10. For convenience, the various parts of the toothbrush 110 are identified by reference numerals higher by one hundred than those used for corresponding parts of the toothbrush 10. Thus, it is necessary only to describe the difference between the toothbrush 110 and the toothbrush 10.

Referring to FIG. 7, one difference in the toothbrush 110 is that the cartridge chamber 120 does not have the laterally offset portion 22 of the cartridge chamber 20. In other words, the cartridge chamber 120 is straight. This results in the advantage that a straight stiff, but collapsible tube may be used in that it does not have to bow, as hereinbefore discussed, but nevertheless still has the advantages of the toothbrush 10 with respect to the laterally offset slide-member chamber 174, automatic longitudinal retraction of the slide member 160 upon withdrawal of a used cartridge 126, lateral latching of the slide member 160 to permit unobstructed insertion of a new cartridge 126, and the like.

Turning to FIGS. 8 and 9, the head 114 of the toothbrush 110 has its bristled surface 116 more-or-less parallel to the axis of the handle 112, instead of being inclined relative thereto as in the case of the head 14 of the toothbrush 10. (The head 114 is also shown as rectangular, but it may also be oval, as in the case of the head 14 of the toothbrush 10).

Because of the angular relationship of the head 114 to the handle 112, the dispensing tip 128 and its opening 130 are bent at such an angle that the terminal portions of the opening and the tip makes angles of no more than about 45°with the bristled surface 116 (considering the smaller of the two angles made by the terminal portions of the tip 128 and the opening 130). The dispensing tip 128 is sufficiently flexible that it can negotiate the bend in the opening 130 during insertion of a fresh cartridge 126, by passing the closure 178, the cartridge 126, and its tip 128, into place. The proper orientation of the self-closing slit 132 may be achieved by correctly aligning the fresh cartridge 126 as it is inserted into the cartridge chamber 120 and allowing the notch to engage the stud. The cross section for the dispensing tip 128 at the self-closing slit 132 may be either of those hereinbefore discussed in connection with FIGS. 3 and 6 of the drawings.

Whether the angled toothbrush head 14 of FIG. 2, or the generally parallel toothbrush head 114 of FIG. 8, is used will depend primarily on the personal preference of the user. The construction of the toothbrush 10 has the advantage of making the cartridge 26 and its dispensing tip 28 easier to insert.

Although exemplary embodiments of the invention have been disclosed for illustrative purposes, it will be understood that various changes, modifications and substitutions may be incorporated in such embodiments without departing from the invention as hereinafter claimed.

I claim as my invention:

1. A dispensing cartridge having a tubular tip of elastomeric material provided with a peripheral wall of nonuniform thickness in cross section and terminating in an end wall, said tip being provided adjacent its terminus with a self-closing slit extending longitudinally of said tip and having a portion formed in said peripheral wall and extending longitudinally of said tip away from said end wall, said peripheral wall, when viewed in cross section, comprising non- concentric inner and outer substantially circular walls, and said portion of said slit being formed in the thinnest portion of said peripheral wall.

2. A dispensing cartridge having a tubular tip of elastomeric material provided with a peripheral wall of nonuniform thickness in cross section and terminating in an end wall, said tip being provided adjacent its terminus with a self-closing slit extending longitudinally of said tip and having a portion formed in said peripheral wall and extending longitudinally of said tip away from said end wall, said peripheral wall having a substantially circular outer cross section and a laterally elongated inner cross section, and said portion of said slit being formed in one of the thicker parts of said peripheral wall.

* * * * *